United States Patent [19]

Garver

[11] 4,082,272

[45] Apr. 4, 1978

[54] TENNIS RACKET STRING POSITIONING DEVICE

[76] Inventor: John P. Garver, 9450 Sharrott Rd., Poland, Ohio 44514

[21] Appl. No.: 716,987

[22] Filed: Aug. 23, 1976

[51] Int. Cl.[2] ..... A63B 53/14

[52] U.S. Cl. ..... 273/73 A

[58] Field of Search ..... 273/73 A, 73 B; 73/145

[56] References Cited

U.S. PATENT DOCUMENTS

| | | | |
|---|---|---|---|
| 2,156,092 | 4/1939 | Johnson | 273/73 A X |
| 2,268,276 | 12/1941 | Caro et al. | 273/73 B X |
| 3,994,496 | 11/1976 | Burchett | 273/73 A |

FOREIGN PATENT DOCUMENTS

| | | | |
|---|---|---|---|
| 121,501 | 6/1946 | Australia | 273/73 A |
| 213,290 | 2/1961 | Austria | 273/73 A |
| 429,526 | 5/1935 | United Kingdom | 273/73 A |
| 432,813 | 8/1935 | United Kingdom | 273/73 A |
| 1,118,777 | 7/1968 | United Kingdom | 273/73 A |

*Primary Examiner*—Richard J. Apley
*Attorney, Agent, or Firm*—Webster B. Harpman

[57] ABSTRACT

A device has an elongated body member with pivoted fingers depending therefrom and notched on their opposite sides for positioning between and engaging with the warp strings of a tennis racket so that simultaneously tilting the fingers sidewardly raises and lowers the warp string alternately from a common plane to facilitate threading the transverse strings therethrough in stringing or restringing the tennis racket.

5 Claims, 3 Drawing Figures

TENNIS RACKET STRING POSITIONING DEVICE

BACKGROUND OF THE INVENTION (1) Field of the Invention

This invention relates to tennis rackets and the like and more particularly to devices for positioning the strings of the racket to facilitate stringing or restringing the same.

(2) Description of the Prior Art

Prior devices have been proposed which engage the alternate warp strings of a racket being strung or restrung so as to lift some of the strings relative to others. Such devices may be seen in U.S. Pat. Nos. 2,028,663, 2,156,092 and 2,268,276.

The present invention provides a simple and easily operated device engaging each of the plurality of the warp threads and alternately raising or lowering them to provide a relatively clear transverse path for restringing the racket.

SUMMARY OF THE INVENTION

A tennis racket string positioning device has a plurality of depending fingers, each of which are notched on their sides adjacent their lower ends for engagement with the warp strings of the racket. The fingers are pivoted at their upper ends to an elongated body member and one of the fingers has a pin engagable in either one of a pair of openings in a latch plate which is secured to the elongated body member. Moving the elongated body member longitudinally tilts each of the fingers and causes the warp strings engaged thereby to be alternately raised and lowered to provide a clear transverse passageway for stringing the transverse strings.

DESCRIPTION OF THE PREFERRED EMBODIMENT

Figure 1:
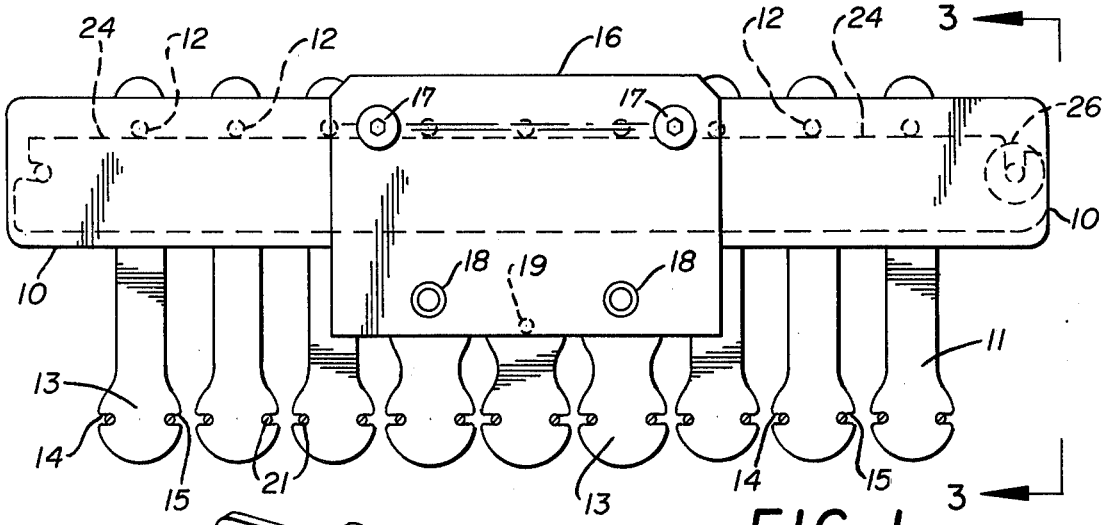
FIG. 1 is a plan view of the tennis racket string positioning device.

In the form of the invention chosen for illustration herein, a tennis racket string positioning device comprises an elongated body member 10 having a plurality of depending similarly formed fingers 11 pivoted thereto in longitudinally spaced relation by a plurality of pivots 12. Each of the fingers 11 has an enlarged lower end portion 13, the opposite sides of which are notched as at 14 and 15 respectively as best illustrated in FIG. 1 of the drawings. A latch plate 16 is movably attached to the elongated body member by rivet fasteners 17 and is provided with a pair of spaced openings 18 adjacent its lower edge which are arranged for registry with a pin 19 which projects outwardly from one of the fingers 11.

Figure 2:
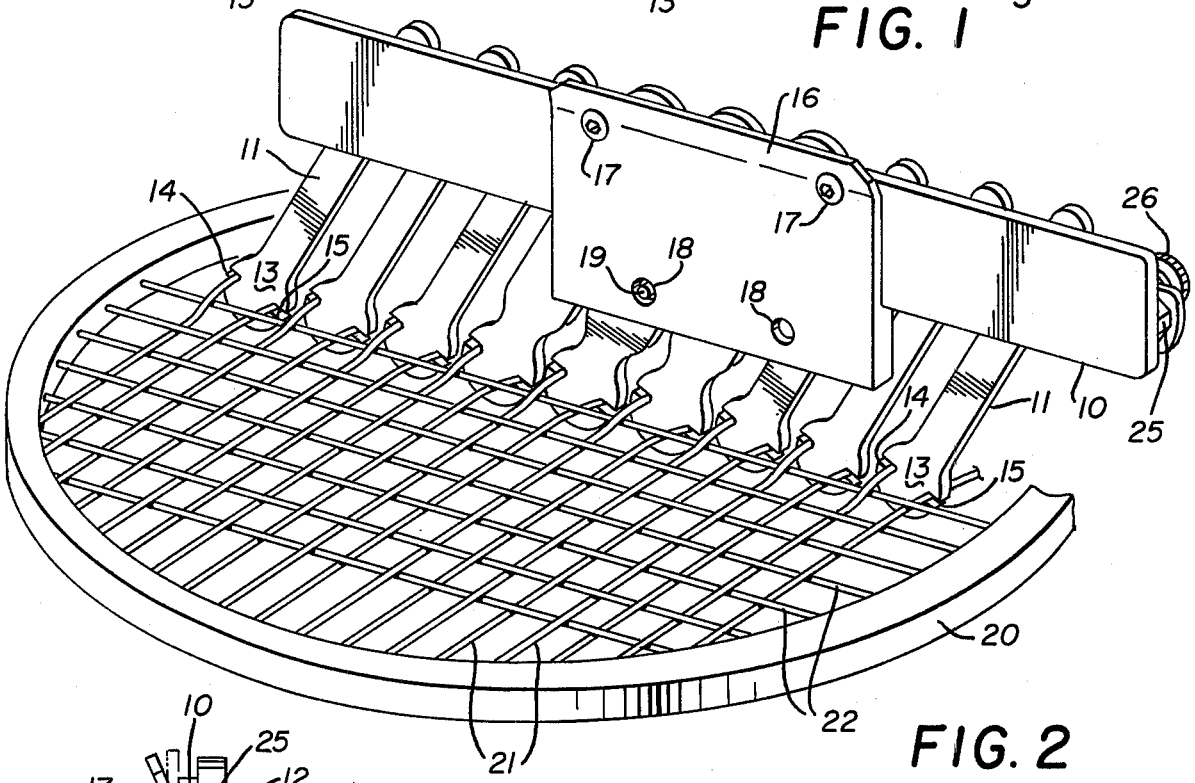
FIG. 2 is a perspective elevation thereof showing the same in position with respect to a broken away view of a tennis racket and engaged on the warp strings thereof.

By referring now to FIG. 2 of the drawings, a partial illustration of a tennis racket or the like may be seen in which the frame is indicated by the numeral 20 and the plurality of warp strings are indicated by the numeral 21. The warp strings are those which extend the longer direction of the tennis racket and in the same direction as the handle thereof (not shown). In FIGS. 1 and 2 of the drawings, the warp strings are shown alternately engaged in the notches 14 and 15 of the opposite sides of the enlarged ends 13 of the depending FIGS. 11.

In FIG. 1 of the drawings the warp strings are all on a common horizontal plane and the fingers 11 are all vertical and the notches 14 and 15 are on a common horizontal plane with the warp strings 21.

In FIG. 2 of the drawings, the elongated body member 10 has been moved to the right relative to the frame 20 and warp strings 21 of the tennis racket. The notches 14 and 15 in the lower end portions 13 of the fingers 11, being engaged upon the warp strings 21, cannot move to the right, each of the fingers 11 can tilt about a pivot axis between each of the warp strings 21 and they do so when the body member 19 is moved to the right relative to the tennis racket as seen in FIG. 2 of the drawings. The fingers 11 then assume the position shown in FIG. 2 of the drawings. The pin 19 on one of the fingers 11 moves with the fingers 11 to a position adjacent one of the openings 18 in the latch plate 16. The latch plate 16 can then be moved to the position shown in solid lines in FIG. 3 of the drawings to engage one of the openings 18 on the pin 19 which holds the device in set position as seen in FIG. 2. Still referring to FIG. 2, it will be seen that and all of the fingers 11 have assumed a tilted position wherein the notches 14 and 15 in their enlarged lower ends 13 have assumed an angular relation relative to the horizontal plane on which the transverse strings 22 are normally positioned. When this occurs the warp strings 21 engaged in the notches 14 are elevated with respect to the normal horizontal plane thereof and the warp strings 21 in the notches 15 are moved downwardly relative to the same horizontal plane. Thus a transverse passageway on the normal horizontal plane is opened up so that the transverse strings 22 can be easily positioned therethrough.

Figure 3:
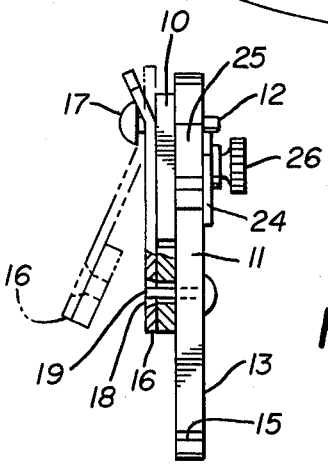
FIG. 3 is an end elevation on line 3—3 of FIG. 1.

It will occur to those skilled in the art that after each transverse string 22 is so positioned, the latch plate 16 is moved to the broken line position seen in FIG. 3 of the drawings to release the pin 19, the elongated body member 10 moved to the left and the fingers 11 assume a vertical position returning the warp strings 21 to the normal horizontal plane thereof.

In order that the next transverse string be properly positioned, the device is moved away from the last installed string and the body member moved to the left causing the depending fingers 11 to tilt in an opposite direction to that shown in FIG. 2 of the drawings whereupon the warp strings 21 are alternately raised and lowered but in an opposite relation to the last operation so that passing the next transverse string through the passageway thus provided positons the transverse string in the desired woven effect such as shown in FIG. 2 with respect to the transverse strings 22 already installed. The operation is repeated until all of the transverse strings are installed.

By referring now to FIG. 3 of the drawings, it will be seen that a secondary elongated body member 24 is detachably fastened on the back side of the elongated body member 10 in spaced parallel relation thereto by means of a pair of offset brackets 25 so that it extends along the back surfaces of the depending fingers 11 and assists in holding them in desired parallel position as seen for example in FIG. 2 of the drawings. The secondary elongated member 24 is notched inwardly from one of its ends and transversely adjacent its opposite end so that it can be positioned between a projecting portion of one of the offset brackets 25 and a thumb screw 26 which serves to hold it in desired position when tightened. The longitudinal distance between the offset brackets 25 is sufficient to permit the depending fingers 11 to move to left or right as hereinbefore described.

It will thus be seen that a tennis racket string positioning device has been disclosed which may be conveniently and easily positioned between the warp strings of a tennis racket and actuated to raise and lower the alternate warp strings so as to provide transverse clearance for the insertion of the transverse strings of the racket in an original or restringing operation.

Although but one embodiment of the present invention has been illustrated and described, it will be apparent to those skilled in the art that various changes and modifications may be made therein without departing from the spirit of the invention.

Having thus described my invention what I claim is:

1. A tennis racket string positioning device for engagement with one set of parallel strings of a tennis racket comprises an elongated body member for positioning transversely of said parallel strings, a plurality of longitudinally spaced pivots on said elongated body member and a plurality of longitudinally spaced depending elongated fingers, the upper end of each of said depending fingers being movably engaged on one of said pivots, inwardly extending notches in the opposite sides of each of said depending fingers adjacent their free ends, said notches arranged for engagement with said strings when positioned therebetween whereby longitudinal movement of said elongated body member causes said pivoted ends of said depending fingers to move transversely of said strings and causes said depending fingers to move to angular positions relative to said elongated body member and means on said elongated body member for detachably engaging at least one of said elongated depending fingers so as to hold it in desired angular relation to said elongated body member.

2. The device of claim 1 and wherein the notches are on a common horizontal plane when the fingers are perpendicular to said elongated body member.

3. The device of claim 1 and wherein the free ends of said depending fingers are each of a width greater than the spaces between said strings, with the notches formed inwardly thereof defining a distance the same as the spaces between said strings.

4. The device of claim 1 wherein the depending fingers are sections of flat material with the free ends enlarged and shaped in a circle.

5. The device of claim 1 and wherein a pin projects from one of said fingers below its pivotal connection with said elongated body member and said means for detachably engaging said finger comprises an apertured latch plate movably attached to said elongated body member with said aperture located for registry with said pin when said finger is in a desired angular relation to said elongated body member.

* * * * *